US006150756A

United States Patent [19]

Wakelkamp et al.

[11] Patent Number: 6,150,756

[45] Date of Patent: Nov. 21, 2000

[54] METHOD OF MANUFACTURING A COATING ON A DISPLAY WINDOW AND A DISPLAY DEVICE COMPRISING A DISPLAY WINDOW PROVIDED WITH A COATING

[75] Inventors: Wilhelmus J. J. Wakelkamp; Leonardus T. M. Van Hout; Angelina C. L. Van De Poel; Johannes M. A. A. Compen, all of Eindhoven, Netherlands

[73] Assignee: U.S. Philips Corporation, New York, N.Y.

[21] Appl. No.: 09/241,008

[22] Filed: Feb. 1, 1999

[30] Foreign Application Priority Data

Jan. 30, 1998 [EP] European Pat. Off. ..... 98200279

[51] Int. Cl.[7] ..... H01J 29/00; H01J 31/00

[52] U.S. Cl. ..... 313/479

[58] Field of Search ..... 313/479, 480

[56] References Cited

U.S. PATENT DOCUMENTS 5,412,279 5/1995 De Boer ..... 313/479

5,750,054 5/1998 Cinquina et al. ..... 252/500

FOREIGN PATENT DOCUMENTS 0603941 6/1994 European Pat. Off. .

OTHER PUBLICATIONS

"Anti–Glare, Anti–Reflection and Anti–Static (AGRAS) Coating for CRTs" by H. Tohda et al., in Japan Display 1992, pp. 289–292.

*Primary Examiner*—F. L. Evans
*Attorney, Agent, or Firm*—John C. Fox

[57] ABSTRACT

A display device (1) with a display window (3) provided with an anti-static, light-absorbing coating (9) on the basis of silicon dioxide comprising an electroconductive, light-absorbing pigment or dye, for example soot (carbon black). A method of providing the display window (3) with an anti-static, light-absorbing coating (9).

16 Claims, 3 Drawing Sheets

METHOD OF MANUFACTURING A COATING ON A DISPLAY WINDOW AND A DISPLAY DEVICE COMPRISING A DISPLAY WINDOW PROVIDED WITH A COATING

BACKGROUND OF THE INVENTION

The invention relates to a method of manufacturing an anti-static, light-absorbing coating on a display window.

The invention further relates to a method of manufacturing an anti-static, light-absorbing coating consisting of more than one layer on a display window.

The invention also relates to a display device comprising a display window provided with an anti-static, light-absorbing coating.

Anti-static coatings are applied to the display window of a display device, for example to cathode ray tubes, or to the display window of a plasma display panel (PDP). These layers are sufficiently electroconductive to ensure that a high electrostatic voltage present on the outer surface of the display window is removed within maximally a few seconds. By virtue thereof, it is precluded that a user experiences an unpleasant shock if he touches a display window. In addition, the attraction of atmospheric dust is reduced.

An anti-static layer comprises an electroconductive material, which customarily includes antimony-doped tin oxide (ATO). Known coatings comprise, in addition to said anti-static layer, one or more layers having, for example, an anti-reflective or anti-glare effect, or a layer which improves the scratch resistance or selectively influences the light transmission. These further layers are customarily provided by spinning or spraying a silica layer.

A method of the type mentioned in the opening paragraph is known from "Japan Display 1992—pp. 289–292: "Anti-Glare, Anti-Reflection and Anti-Static (AGRAS) Coating for CRTs"" by H. Tohda et al. In said document, a description is given of a method in which a display window is provided with a conductive (anti-static) SnO layer by means of CVD (Chemical Vapor Deposition), whereafter a central and outer $SiO_2$ layer is provided by spinning and spraying, respectively, and a thermal treatment.

This method is laborious and time-consuming; the CVD process takes place in a separate reaction chamber. After the application of the SnO layer, the surface is subjected to polishing and cleaning treatments.

OBJECTS AND SUMMARY OF THE INVENTION

It is an object of the invention to provide a simple method of manufacturing an anti-static, light-absorbing coating.

The object of providing a simple method of manufacturing an anti-static, light-absorbing coating on a display window is achieved in accordance with the invention in that a suspension comprising an alkoxy-silane compound and an electroconductive, light-absorbing pigment or dye is provided on the display window and dried, whereafter the anti-static, light-absorbing coating is formed by means of a treatment at an increased temperature, during which temperature treatment the alkoxy-silane compound is converted to silicon dioxide, and the resultant anti-static, light-absorbing coating consists of one layer.

On the basis of such a mixture, a single-layer anti-static, light-absorbing coating is obtained, the electroconductive properties of the pigment or dye bringing about the anti-static effect, and the light-absorbing properties of the pigment or dye selectively influencing the light transmission. In order to determine both the anti-static and the light-transmission properties of the coating, the known coating is composed of a stack of at least two layers. By incorporating the alkoxy-silane compound in the suspension, said compound is converted (after the application of the suspension to the display window) into silicon dioxide during the thermal treatment. By virtue thereof, the central and outermost $SiO_2$ layers of the known anti-static coating can be dispensed with. Since the coating comprises only one layer, a considerable simplification of the method is achieved. The combination of silicon dioxide and the pigment or dye in a single coating brings about a sensitivity to finger prints, and a hardness and scratch resistance of the coating formed, which are better or at least comparable to the sensitivity to finger prints, hardness and scratch resistance of the known two-layer anti-static coating.

A method of manufacturing an anti-static, light-absorbing coating comprising more than one layer on a display window, is characterized in accordance with the invention in that a porous layer of particles of an electroconductive, light-absorbing pigment or dye is applied to the display window, whereafter a second layer of an alkoxy-silane compound is applied, said alkoxy-silane compound penetrating the first layer and, subsequently, said alkoxy-silane compound being converted to silicon dioxide by means of a treatment at an increased temperature.

The penetrating alkoxy-silane compound causes the porous layer to be sealed and bonded to the surface of the display window. Treating the first layer, for example polishing and cleaning it, in order to obtain a proper bonding between the first and the second layer, is not necessary. As a result, a considerable simplification of the method is achieved. This embodiment of the method also has the advantage that it is possible to apply a subsequent layer to the anti-static layer without previously curing the anti-static, light-absorbing layer. The alkoxy-silane compound can be converted to silicon dioxide at relatively low temperatures (up to 200° C.). This enables a simplification of the method to be attained.

The known anti-static, light-absorbing coatings customarily comprise at least two layers, the anti-static properties being conferred on the (first) layer by incorporating particles of antimony-doped tin oxide (ATO). ATO is a relatively expensive material. In addition, in the known coating, a second layer is applied after the application of the layer of ATO particles, in order to give the coating the necessary strength and scratch resistance. If it is desirable to influence the light transmission of the coating, said second layer may comprise a dye or a pigment. A suitable choice of the layer thickness and refractive index of the first and second layer enables the assembly of the first and second layer to serve also as an anti-reflective coating.

An embodiment of the method in accordance with the invention is characterized in that the electroconductive, light-absorbing pigment or dye is selected from the group formed by black pigments, metals, metal oxides, metal nitrides and organic polymers.

The addition of such a pigment or dye causes both the electric conductance (anti-static effect) and the light transmission of the coating to be selectively influenced. Such pigments or dyes are chosen in such a manner that the light emitted by the phosphors of a cathode ray tube is selectively passed, whereas, for example, the ambient light reflecting at the rear side of the display window is absorbed. An example of a black pigment is soot, for example "carbon black", for example in the form of finely distributed electroconductive soot particles which are (preferably homogeneously and uniformly) distributed over the coating. Examples of suitable metal oxides or metal nitrides include ruthenium oxide ($RuO_2$), iron oxide ($Fe_3O_4$) and titanium nitride (TiN). Suitable polymers having the desired electroconductive properties are, for example, polypyrrole, polyaniline and poly-3,4-ethylene dioxythiophene (PEDOT).

In a preferred embodiment of the invention, soot is added to the suspension. Soot particles are really black, chemically inert and relatively cheap as compared to ATO particles. Soot particles are electroconductive, thus bringing about the anti-static effect of the coating. In addition, the soot particles are responsible for the light-absorbing properties of the coating. An example of a suitable dye is Microsol Black 2B. In view of the optical properties, uniformity and homogeneity of the coating, it is desirable that the soot particles have uniform dimensions. The soot particles preferably have an average diameter in the range between 1 and 200 nm, preferably between 5 and 40 nm. The invention is important, in particular, for a single-layer anti-static, light-absorbing coating of silicon dioxide comprising soot as the electroconductive material, which soot particles selectively influence the light transmission.

In a further embodiment of the invention, latex particles of polypyrrole are added to the suspension, which particles contribute to the light-absorbing properties of the coating. After drying, the coating comprises polypyrrole-latex particles. For the polypyrrole compound use can be made of polypyrrole, N-substituted polypyrrole and J-substituted polypyrrole. For the substituents use can be made of alkyl groups with, for example, up to 5 carbon atoms, aryl groups, alkoxy groups, nitro groups and halogen atoms. Preferably, the latex particles are composed of unsubstituted polypyrrole.

Preferably, the latex particles have uniform dimensions (optical properties, uniformity and homogeneity of the coating). The latex particles are spherical and their average diameter preferably ranges between 50 and 150 nm. In such an embodiment, anti-static and light-absorbing properties are combined in a single layer.

The layer thickness of the coating ranges between 50 and 200 nm. The color of the coating is neutral grey.

Preferably, it should also be possible to carry out the method at relatively low temperatures. Relatively low temperatures generally reduce the process time and the risk of damage of the substrate (the display window) as a result of thermal stresses. The use of an alkoxy-silane compound in the suspension enables the applied layer to be converted, after drying, to silicon dioxide at relatively low temperatures up to 200° C. The conversion to silicon dioxide takes place, for example, by means of a treatment of at least 30 minutes at a temperature ranging between 150 and 170° C. The alkoxy groups of the alkoxy-silane compound are converted to hydroxy groups by acidified water, which hydroxy groups react with each other and with hydroxy groups of the glass surface of the display window. During drying and heating, polycondensation causes a properly bonding network of silicon dioxide to be formed.

Preferably, the suspension is applied to the display window by spinning or spraying. By virtue thereof, the layer thickness of the coating, which layer thickness determines, inter alia, the optical and electrical properties of the coating, can be readily controlled. By spinning the alkoxy-silane solution, a homogeneous, smooth layer is obtained. If necessary, a surface-active substance is added to the solution, for example in quantities ranging from 0.001 to 5% by weight. The terms "spinning" or "spin coating" customarily refer to a method in which a layer is applied to a rotating part, in this case a display window. During the so-called "spraying" operation, an alcoholic solution of an alkoxy-silane compound is applied to a substrate (the display window) by means of spraying means, whereafter a treatment at an increased temperature is carried out, thereby forming a layer of silicon dioxide. The layer thus formed is scratch-resistant and may possess anti-glare properties. The anti-glare effect is substantially independent of the wavelength of light. Spraying of the alkoxy-silane solution results in a matt surface texture, so that the layer formed exhibits a so-called anti-glare effect. As a result, ambient light is diffusely reflected.

The method in accordance with the invention can be used to apply a coating to a display window of a display device. Within the scope of the invention, it has been realized that the preferred method is applicable, and preferably is applied, to apply coatings to a display window which is a part of a cathode ray tube.

In the method disclosed in the above-mentioned article in Japan Display, a coating is applied to an unassembled display window, that is, first a display window is provided with a coating, and the cathode ray tube is not assembled until after the display window has been provided with a coating. This holds the risk of the coating being damaged during the assembly of the cathode ray tube. This risk is avoided by applying the coating to a display window which forms part of a cathode ray tube. The known method cannot be used for this purpose.

An alkoxy-silane compound which can suitably be used in the methods in accordance with the invention is tetraethyl orthosilicate (TEOS). Also other known alkoxy-silane compounds of the $Si(OR)_4$ type and oligomers thereof can be used, where R is an alkyl group, preferably a $C_1$–$C_5$ alkyl group. For the solvent use is made, for example, of ethanol, isopropanol or n-propanol.

The display device mentioned in the opening paragraph is characterized in accordance with the invention in that the anti-static, light-absorbing layer comprises an electroconductive, light-absorbing pigment or dye in silicon dioxide, which pigment or dye is responsible for the electric conductance as well as for the light transmission of the coating. By means of such a pigment or dye, both the electric conductance (anti-static effect) and the light transmission of the coating are selectively influenced. By combining both properties (electric conductance and light absorption) in one material, the desired anti-static, light-absorbing properties can be achieved in a single-layer coating, while the known coating customarily comprises a first anti-static layer followed by a second layer for adjusting the desired light transmission.

In a preferred embodiment, the display device is characterized in that he light transmission (T) of the anti-static, light-absorbing layer ranges between 40 and 85% ($0.4 \leqq T \leqq 0.85$), preferably $T \approx 60\%$.

In general, a pigment or dye is included in the (glass) material of the display window of the display device, as a result of which the light transmission of the display window of the display device (without the coating) is set to range between approximately 40 and 60%. Such a relatively low light transmission value is desirable to obtain a good contrast of the image displayed under daylight conditions. Since, however, the thickness of the display window is not the same everywhere, differences in brightness occur in the images displayed by the display device. Particularly near the edges and near the vertices of the display window, the glass is relatively thicker, resulting in a higher light absorption than in the center of the display window, where the glass thickness is relatively small. Such effects are visible, disturbing and hence undesirable. The inventors have realized that it is better to substantially increase the light transmission (T) of the glass material of the display window ($T \geqq 60\%$, preferably $T \approx 80\%$): as a result, variations in brightness of the image displayed caused by differences in thickness of the display window are hardly, or not at all, observable by a viewer watching the images displayed by the display device. The desirable reduction in light transmission is subsequently brought about by adding sufficient dye or pigment to an anti-static coating provided on the outside of the display window. In order to obtain a coating demonstrating a sufficient anti-static effect, while using particles in accordance with the invention having both electroconductive and light-absorbing properties, it is desirable to incorporate a relatively large quantity of such particles in the coating. Particularly soot particles are relatively cheap compared to ATO particles. In addition, soot particles are really black and not subject to discoloration during the service life of the display device, and the soot particles form a chemically inert material (no corrosion). Besides, soot particles are electroconductive and light-absorbing. An additional advantage is that, since the transmission of the layer can be adjusted by adapting the quantity of electroconductive and light-absorbing pigment or dye in the layer, the glass composition of the display windows no longer has to be adapted for different types of display windows: the light transmission of such display windows is preferably $T \geqq 60\%$, a particularly suitable value is $T \approx 80\%$. Preferably, the light transmission of the anti-static, light-absorbing layer ranges between 40 and 85%. In a preferred embodiment of the display device, the light transmission of the anti-static, light-absorbing layer is at least substantially 60%. At this value, a layer having an excellent anti-static effect is obtained. A particularly suitable combination is formed by a display window having a light transmission $T \approx 80\%$, which is provided with an anti-static, light-absorbing layer or coating having a light transmission $T \approx 60\%$. A sufficient anti-static effect of the layer is achieved if the surface resistance of the layer is below $10^{10}$ Ω/□.

These and other aspects of the invention will be apparent from and elucidated with reference to the embodiments described hereinafter.

BRIEF DESCRIPTION OF DRAWING

In the drawings.

The Figures are purely schematic and not drawn to scale. In particular for clarity, some dimensions are exaggerated strongly. In the Figures, like reference numerals refer to like parts whenever possible.

DESCRIPTION OF THE PREFERRED EMBODIMENTS

Figure 1A:
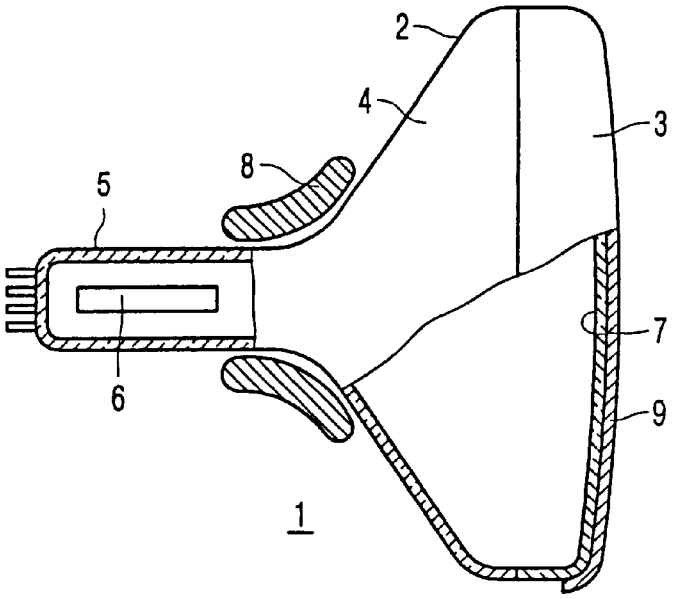
FIG. 1A is a partly cut-away view of a display device comprising a cathode ray tube provided with a coating in accordance with the invention.

FIG. 1A is a schematic, cut-away view of a display device comprising a cathode ray tube (CRT) 1 with a glass envelope 2 including a display window 3, a cone 4 and a neck 5. The neck accommodates an electron gun 6 for generating one or more electron beams. Said electron beam(s) is (are) focused on a phosphor layer 7 on the inside of the display window 3. The electron beam(s) is (are) deflected across the display window 3 in two mutually perpendicular directions by means of a deflection coil system 8. The display window 3 of the display device 1 is provided on the outside with a coating 9 in accordance with the invention. Preferably, the coating is applied directly to the outside of the display window of the display device (see FIG. 1A). In an alternative embodiment, the coating is provided on a (flat) so-called separate front panel, which is situated on the viewing side of the display device in front of the display window.

Figure 1B:
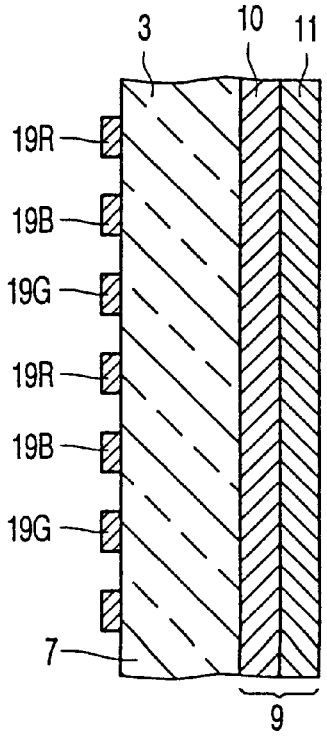
FIG. 1B is a cross-sectional view of a detail of FIG. 1A.

FIG. 1B is a cross-sectional view of a detail of FIG. 1A, in which the phosphor layer 7 on the inside of the display window 3 comprises a regular pattern of (electro) luminescent pixels 19R, 19G, 19B. The pixels 19R, 19G, 19B each include a suitable phosphor of the right color: red 19 R, green 19 G or blue 19 B. An anti-static coating 9 is applied to the display window 3. In the example of FIG. 1B, the coating 9 comprises two layers, namely an anti-static, electroconductive coating 10 containing electroconductive, light-absorbing particles (not shown in FIG. 1B), for example soot particles, embedded in a second compound, in this example silicon dioxide. The coating 9 further comprises a coating 11 of, for example, silicon dioxide.

In the method in accordance with the invention, a suspension comprising an alcoholic alkoxy-silane compound (for example TEOS) and conductive particles of a dye or pigment (for example soot particles) is provided on the display window 3. After applying and drying the layer, a thermal treatment is carried out. As a result of this treatment, a single-layer anti-static, light-absorbing coating on the basis of silicon dioxide is formed.

In an alternative embodiment in accordance with the invention, the display screen 3 is first provided with a porous layer 10. This porous layer is applied, for example and preferably, by applying an alcoholic solution of soot particles to the display screen 3 and drying said solution. A second layer 11 of an alkoxy-silane compound is applied to the layer 10, said compound partly penetrating into the first layer. After application of the second layer 11, a thermal treatment is carried out, resulting in the formation of a silicon dioxide layer 11. If desirable, a third layer is applied to achieve an anti-glare effect, for example by spraying a silicon-dioxide, anti-glare layer.

Hereinbelow, a description will be given of a few embodiments in accordance with the invention.

Exemplary Embodiment 1

In this embodiment, a description is given of a method and a display device, whereby the electrical properties and the transmission of visible light of a single-layer coating are influenced by incorporating electroconductive, light-absorbing soot particles in the coating.

A solution of an alkoxy-silane compound is prepared, in which 74 g TEOS (tetraethoxy-silane) are added to 245 g ethanol (p.a.) and 5.4 g 0.175 M HCL and 28 g $H_2O$, which mixture is stirred for 10 minutes and, subsequently, hydrolyzed for 24 hours.

A quantity of 100 g of the above mixture is mixed with 170 g ethanol. A quantity of 5.00 g of soot particles (gas soot sol, Microsol Black 2B), which is diluted with 45.0 g of demineralized water is stirred into this mixture. The soot particles have an average size in the range between 1 and 200 nm, preferably between 5 and 40 nm. Soot particles tend to coagulate (flocculation); in this application, particle size is to be taken to mean the "primary" particle size of the soot particles.

Preferably, before using the suspension obtained, it is provided with a dispersing agent, for example 4.00 g of a 1% so-called Silwet solution (L7602), and subsequently sieved over a nylon sieve gauze having a pore size of 1 $\mu$m.

The suspension thus obtained is spin coated (for example at 300 revolutions per minute) onto a display window which forms part of a cathode ray tube. After drying in air, the resultant layer is maintained at a temperature of 160° C. for approximately 90 minutes, thus forming a properly bonding, smooth layer of silicon dioxide.

Figure 2:
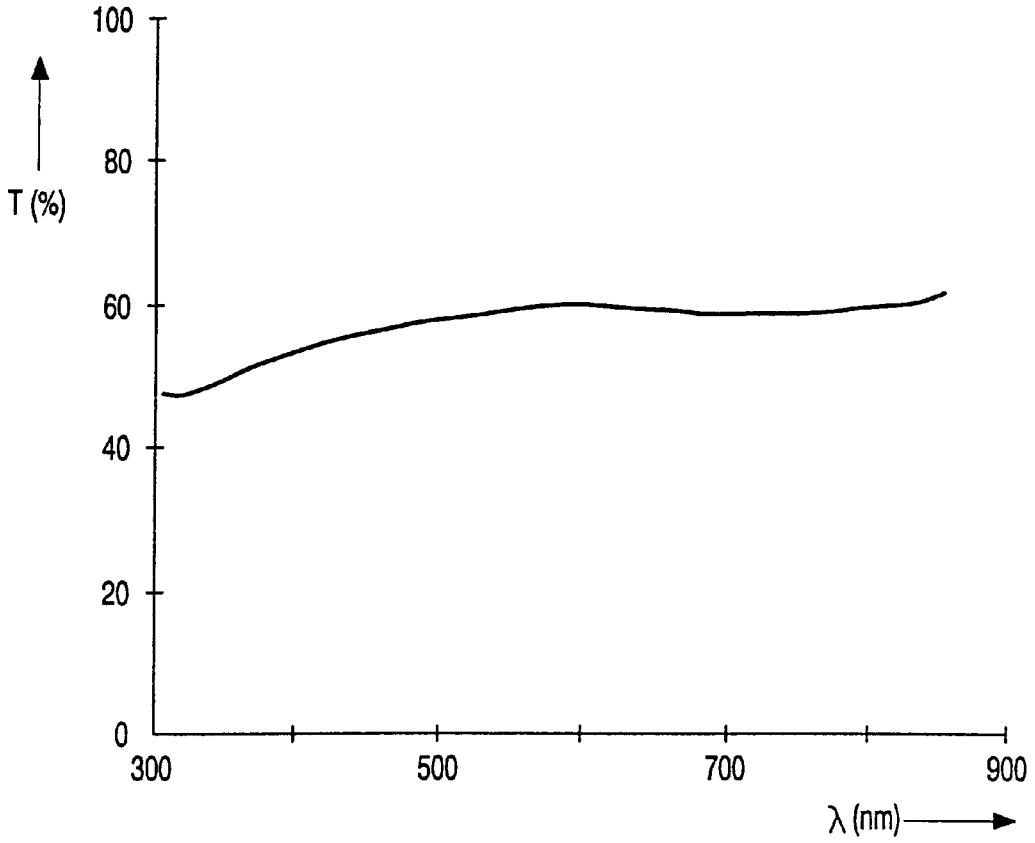
FIG. 2 shows the light transmission T (in %) as a function of the wavelength λ (in nm) of a single-layer, anti-static, light-absorbing coating in accordance with the invention.

After drying, a homogeneous, neutral-grey coating having a layer thickness of approximately 130 nm is obtained, which has an electric resistance of $2\times10^9$ Ω/□. This is amply sufficient for the desired anti-static effect (surface resistance below $10^{10}$ Ω is desirable) and enables the light transmission properties to be brought to the desired value by changing the layer thickness and the soot concentration, while preserving the necessary anti-static effect. The light transmission T (in %) as a function of the wavelength λ (in nm) of the coating obtained is shown in FIG. 2. At 550 nm, the light transmission is 57%. The resistance value of the single-layer, anti-static, light-absorbing coating thus obtained is comparable to values achieved with layers of silicon dioxide in which ATO particles or polypyrrole particles with a steric stabilizer are dispersed. The anti-static, light-absorbing layer thus formed comprises approximately 1.4 mol C per mol $SiO_2$.

Exemplary Embodiment 2

In this embodiment, a description is given of a method and a display device, whereby the electrical properties and the transmission of visible light of a two-layer coating 10, 11 are influenced by incorporating electroconductive, light-absorbing soot particles in a first layer 10 of the coating.

For the first layer, 5.00 g soot particles (gas soot sol, Microsol Black 2B) are diluted with 145 g of demineralized water. To this is added a quantity of 200 g ethanol and the following dispersing agents: 4.00 g Silwet (L7607; 1% in ethanol) and 4.00 g Silwet (L7602; 1% in ethanol). The soot particles have an average size in the range between 1 and 200 nm, preferably between 5 and 40 nm. Before it is used, the suspension is sieved over a 5 $\mu$m membrane filter.

For the second layer, 30.0 g TEOS is mixed with 15.0 g ethanol (p.a.) and 15.0 g 0.03 M HCL. The whole is properly mixed until TEOS is properly dissolved (initially there are two phases in the mixture). Before it is used, the mixture is sieved over a 0.2 $\mu$m membrane filter.

The first layer 10 is spin coated (for example at 300 revolutions per minute) onto a display window which forms part of a cathode ray tube. After drying the first layer, the second layer 11 is spin coated (for example at 400 revolutions per minute) onto the first layer, whereby a part of the suspension of the second layer 11 penetrates the first layer 10. After drying in air, the layer obtained is maintained at a temperature of 160° C. for approximately 90 minutes, thus forming a two-layer, properly bonding, smooth coating comprising a first anti-static, light-absorbing layer 10 of soot particles embedded in silicon dioxide and a second layer 11 comprising silicon dioxide.

Figure 3A:
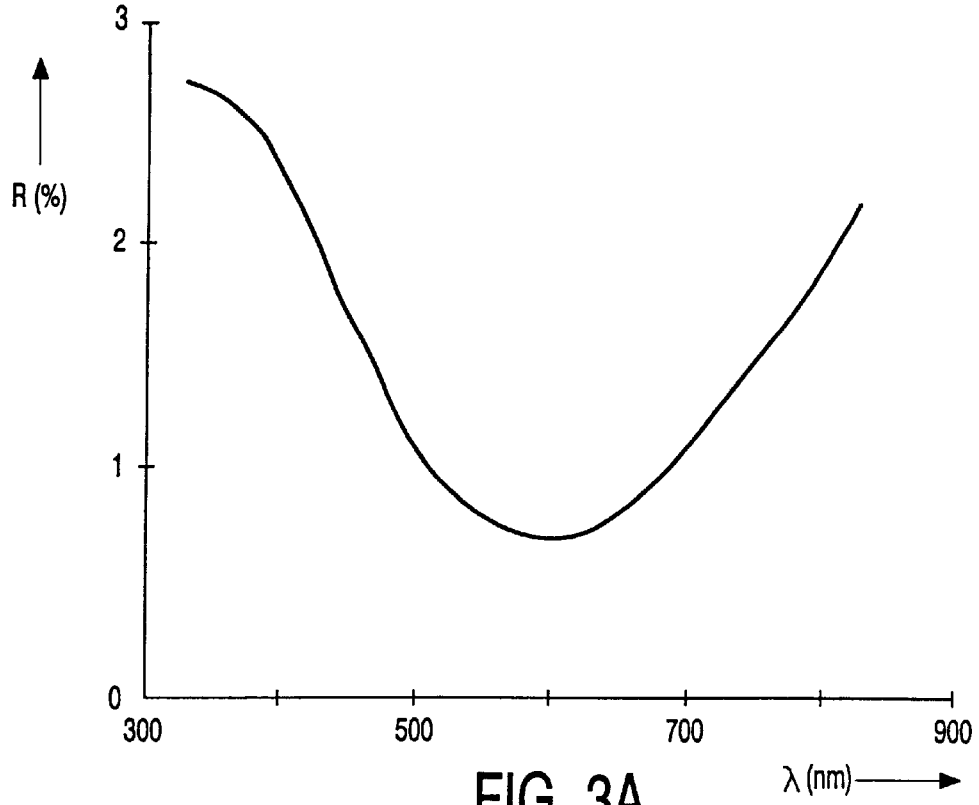
FIGS. 3A and 3B show the reflection R (in %) and the light transmission T (in %) as a function of the wavelength λ (in mn) of a two-layer, anti-static, light-absorbing coating in accordance with the invention.
Figure 3B:
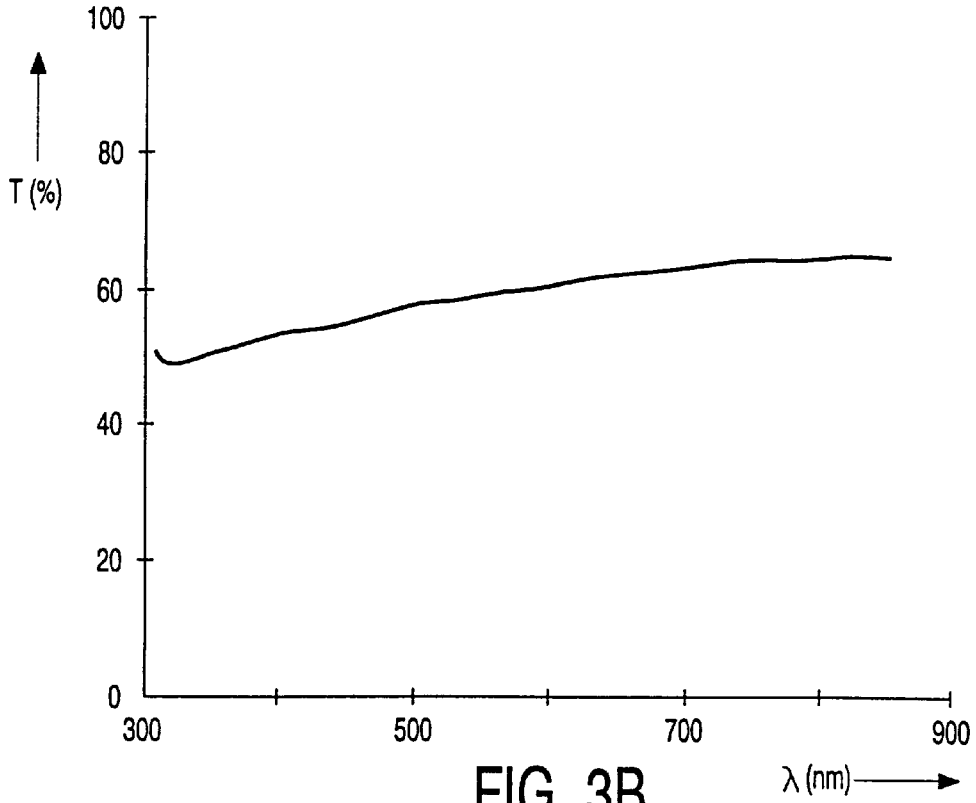

The reflection of the assembly of the two layers 9 can be influenced by changing the thickness of the second layer 11 relative to that of the first layer 10. FIG. 3A shows the reflection of the two-layer coating 10, 11 as a function of the wavelength of visible light. At 615 nm, the reflection minimum is 0.8%. The light transmission T (in %) as a function of the wavelength λ (in nm) of the coating obtained is shown in FIG. 3B. At 550 nm, the light transmission is 57%. The electric resistance of the first layer of the coating 9 is $9\times10^5$ Ω/□.

The light transmission of the coating can be set to the desired value by changing the concentration of the soot particles in the (first) layer.

The scratch resistance of the anti-static coatings in both exemplary embodiments is tested by means of a conical diamond which is moved over the surface with a force of 50 g, and which does not form scratches which are visible to the naked eye.

The hardness is tested by means of a pencil test, in which pencils of different hardnesses to which a force of 7.5 N is applied are moved over the surface of the layer at an angle of 45° and a rate of 0.05 m/s. According to this test, the coating in accordance with the invention has a degree of hardness in the range from 8 H to 9 H.

By means of the invention, effective anti-static, light-absorbing coatings are readily manufactured and provided on a display window of a cathode ray tube, whereby the light transmission properties can be adapted, whether or not as a function of the wavelength of light, in accordance with the requirements.

It will be obvious that, within the scope of the invention, many variations are possible to those skilled in the art. The invention is described by means of an example in which the display device is a cathode ray tube. Because of the protective effect of the anti-static filter, the invention is important, particularly, for cathode ray tubes, however, it is not limited thereto. The invention is also important for other types of display devices, such as LCDs and plasma displays. Particularly for Plasma Display Panels (PDPs) and for so-called plasma-addressed liquid crystal (PALC) displays use can advantageously be made of the invention. In such devices, plasma discharges take place and an image is represented. As a result of these plasma discharges, static charges may accumulate on the display window and electromagnetic stray fields may be generated. In the example described above, the conductive layer is applied directly onto the display window. This is a preferred embodiment. However, the invention is not limited thereto. In embodiments, further transparent layers may be situated between the conductive layer and the display window.

What is claimed is:

1. A method of manufacturing an anti-static, light-absorbing coating (9) on a display window (3), characterized in that a suspension comprising an alkoxy-silane compound and an electroconductive, light-absorbing pigment or dye is provided on the display window (3) and dried, whereafter the anti-static, light-absorbing coating (9) is formed by means of a treatment at an increased temperature, during which temperature treatment the alkoxy-silane compound is converted to silicon dioxide, and the resultant anti-static, light-absorbing coating (9) consists of one layer.

2. A method as claimed in claim 1, characterized in that the light transmission of the anti-static, light-absorbing layer (9) ranges between 40 and 85%.

3. A method as claimed in claim 1, characterized in that the electroconductive, light-absorbing pigment or dye is selected from the group formed by black pigments, metals, metal oxides, metal nitrides and organic polymers.

4. A method as claimed in claim 3, characterized in that the black pigments comprise soot particles.

5. A method as claimed in claim 1, characterized in that the suspension is provided by spinning or spraying.

6. A method as claimed in claim 3, characterized in that the light transmission of the anti-static, light-absorbing layer (9) is at least about 60%.

7. A method of manufacturing an anti-static, light-absorbing coating (9), consisting of more than one layer on a display window (3), characterized in that a porous layer (10) of particles of an electroconductive, light-absorbing pigment or dye is applied to the display window, whereafter a second layer (11) of an alkoxy-silane compound is applied, said alkoxy-silane compound penetrating the first layer (10) and, subsequently, said alkoxy-silane compound being converted to silicon dioxide by means of a treatment at an increased temperature.

8. A display device comprising a display window (3) provided with an anti-static, light-absorbing layer (9), characterized in that the anti-static, light-absorbing layer (9) comprises an electroconductive, light-absorbing pigment or dye in silicon dioxide, which pigment or dye is responsible for the electric conductance as well as for the light transmission of the layer (9).

9. A display device as claimed in claim 8, characterized in that the light transmission of the anti-static, light-absorbing layer (9) ranges between 40 and 85%.

10. A display device as claimed in claim 8, characterized in that the light transmission of the display window exceeds 60%.

11. A display device as claimed in claim 8, characterized in that the electroconductive, light-absorbing pigment or dye is selected from the group formed by black pigments, metals, metal oxides, metal nitrides and organic polymers.

12. A display device as claimed in claim 11, characterized in that the black pigments comprise soot particles having an average diameter ranging between 1 and 200 nm.

13. A display device as claimed in claim 8, characterized in that the layer (9) has a surface resistance below $10^{10}$ Ω/□.

14. A display device as claimed in claim 9, characterized in that the light transmission of the anti-static, light-absorbing layer (9) is at least about 60%.

15. A display device as claimed in claim 10, characterized in that the light transmission of the display window is at least about 80%.

16. A display device as claimed in claim 12, characterized in that the black pigments comprise soot particles having an average diameter ranging between 5 and 40 nm.

* * * * *